US009702240B2

(12) United States Patent
Bittar et al.

(10) Patent No.: US 9,702,240 B2
(45) Date of Patent: Jul. 11, 2017

(54) APPARATUS AND METHOD OF LANDING A WELL IN A TARGET ZONE

(75) Inventors: Michael S. Bittar, Houston, TX (US); Baris Guner, Kingwood, TX (US); Burkay Donderici, Houston, TX (US); Luis E. San Martin, Houston, TX (US)

(73) Assignee: Halliburton Energy Service, Inc., Houston, TX (US)

( * ) Notice: Subject to any disclaimer, the term of this patent is extended or adjusted under 35 U.S.C. 154(b) by 841 days.

(21) Appl. No.: 13/991,354

(22) PCT Filed: Aug. 3, 2011

(86) PCT No.: PCT/US2011/046389

§ 371 (c)(1),
(2), (4) Date: Jun. 3, 2013

(87) PCT Pub. No.: WO2013/019223

PCT Pub. Date: Feb. 7, 2013

(65) Prior Publication Data

US 2013/0248250 A1 Sep. 26, 2013

(51) Int. Cl.

| | |
|---|---|
| ***G01V 3/00*** | (2006.01) |
| ***E21B 25/16*** | (2006.01) |
| ***E21B 47/02*** | (2006.01) |
| ***G01V 1/40*** | (2006.01) |
| ***G01V 3/18*** | (2006.01) |

(Continued)

(52) U.S. Cl.
CPC ..... *E21B 47/00* (2013.01); *E21B 7/068* (2013.01); *E21B 47/022* (2013.01)

(58) Field of Classification Search
CPC ..... E21B 44/005; E21B 47/022; E21B 44/00
USPC ..... 340/853.3–853.6; 175/45; 166/250.01–250.147; 173/20–21; 702/6–13; 703/10; 33/302–314
See application file for complete search history.

(56) References Cited

U.S. PATENT DOCUMENTS 5,230,386 A 7/1993 Wu et al.
5,467,832 A 11/1995 Orban et al.
(Continued)

FOREIGN PATENT DOCUMENTS

CN 1206778 A 2/1999
CN 1559011 A 12/2004
(Continued)

OTHER PUBLICATIONS

"Australian Application Serial No. 2011374305, Examination Report No. 1 mailed Sep. 30, 2014", 5 pgs.
(Continued)

*Primary Examiner* — Firmin Backer
*Assistant Examiner* — Jerold Murphy

(57) ABSTRACT

Various embodiments include apparatus and methods to land a well in a target zone with minimal or no overshoot of a target zone. The well may be directed to a target in the target zone based on the separation distance between a transmitter sensor (212) and a receiver sensor (214) being sufficiently large to detect a boundary of the target zone from a distance from the boundary of the target zone such that collected received signals from activating the transmitter sensor (212) can be processed in a time that provides minimal or no overshoot of a target zone. Additional apparatus, systems, and methods are disclosed.

25 Claims, 12 Drawing Sheets

(51) Int. Cl.

| | |
|---|---|
| ***E21B 47/022*** | (2012.01) |
| ***E21B 47/12*** | (2012.01) |
| ***E21B 49/00*** | (2006.01) |
| ***E21B 47/00*** | (2012.01) |
| ***E21B 7/06*** | (2006.01) |

(56) References Cited

U.S. PATENT DOCUMENTS

| | | | | |
|---|---|---|---|---|
| 5,508,616 | A | 4/1996 | Sato et al. | |
| 5,996,711 | A | 12/1999 | Ohmer | |
| 6,088,294 | A | 7/2000 | Leggett, III et al. | |
| 6,163,155 | A | 12/2000 | Bittar | |
| 6,188,222 | B1 | 2/2001 | Seydoux et al. | |
| 6,272,434 | B1 * | 8/2001 | Wisler | E21B 7/068 702/11 |
| 6,476,609 | B1 | 11/2002 | Bittar | |
| 6,900,640 | B2 | 5/2005 | Fanini et al. | |
| 7,138,803 | B2 | 11/2006 | Bittar | |
| 7,265,552 | B2 | 9/2007 | Bittar | |
| 7,268,556 | B2 | 9/2007 | Fanini et al. | |
| 7,557,579 | B2 | 7/2009 | Bittar | |
| 7,557,580 | B2 * | 7/2009 | Bittar | G01V 3/28 324/337 |
| 7,755,361 | B2 | 7/2010 | Seydoux et al. | |
| 2004/0154831 | A1 * | 8/2004 | Seydoux | E21B 7/04 175/24 |
| 2006/0151214 | A1 * | 7/2006 | Prange | E21B 7/04 175/45 |
| 2006/0161406 | A1 | 7/2006 | Kelfoun | |
| 2007/0235225 | A1 | 10/2007 | Bittar | |
| 2007/0236221 | A1 | 10/2007 | Merchant et al. | |
| 2008/0078580 | A1 | 4/2008 | Bittar | |
| 2009/0224764 | A1 | 9/2009 | Bittar | |
| 2009/0302851 | A1 | 12/2009 | Bittar et al. | |
| 2009/0309798 | A1 | 12/2009 | Bittar et al. | |
| 2010/0117655 | A1 | 5/2010 | Bittar et al. | |
| 2010/0123462 | A1 | 5/2010 | Bittar | |
| 2012/0046868 | A1 * | 2/2012 | Tchakarov | E21B 7/04 702/9 |
| 2012/0298420 | A1 * | 11/2012 | Seydoux | E21B 47/02 175/26 |

FOREIGN PATENT DOCUMENTS

| | | | |
|---|---|---|---|
| EP | 0553908 | A2 | 8/1993 |
| WO | WO-2006/053294 | A1 | 5/2006 |
| WO | WO-2006053294 | A1 | 5/2006 |
| WO | WO-2009091408 | A1 | 7/2009 |
| WO | WO-2011/049828 | A2 | 4/2011 |
| WO | WO-2013019223 | A1 | 2/2013 |

OTHER PUBLICATIONS

"Malaysian Application Serial No. PI2013001043, Preliminary Examination mailed Feb. 12, 2014", 2 pgs.
Brazilian Application Serial No. BR1120130092866, Amended filed Aug. 23, 2013, (w/ English Translation of Claims), 17 pgs.
"European Application Serial No. 11743737.6, Office Action mailed Apr. 24, 2013", 2 pgs.
"European Application Serial No. 11743737.6, Response filed Oct. 29, 2013 to Office Action mailed Apr. 24, 2013", 17 pgs.
"International Application Serial No. PCT/US2011/046389, International Preliminary Report on Patentability mailed Feb. 13, 2014", 9 pgs.
"Australian Application Serial No. 2011374305, Secound Amendment filed Jun. 3, 2015 in response to Patent Examiners Report No. 2 mailed Feb. 13, 2015", 23 pgs.
"Canadian Application Serial No. 2,842,593, Office Action mailed Mar. 20, 2015", 3 pgs.
"Chinese Application Serial No. 201180072737.9, Office Action mailed May 6, 2015", (w/ English Translation), 22 pgs.
"Malaysian Application Serial No. PI2013001043, Office Action mailed Jun. 15, 2015", 4 pgs.
"Russian Application Serial No. 2014107905, Office Action mailed Feb. 26, 2015", (w/ English Translation), 10 pgs.
"Canadian Application Serial No. 2,842,598, Response filed Aug. 21, 2015 to Office Action mailed Mar. 20, 2015", 18 pgs.
"Malaysian Application Serial No. PI2013001043, Response filed Aug. 6, 2015 to Office Action mailed Jun. 15, 2015", 9 pgs.
"Russian Application Serial No. 2014107905, Response filed Jun. 30, 2015 to Office Action mailed Feb. 26, 2015", (w/ English Translation of Amended Claims), 18 pgs.
"International Application Serial No. PCT/US2011/046389, International Search Report mailed Mar. 27, 2012", 5 pgs.
"International Application Serial No. PCT/US2011/046389, Written Opinion mailed Mar. 27, 2012", 7 pgs.
Seydoux, J, et al., "A deep-resistivity logging-while-drilling-device for proactive geosteering", Offshore Technology Conference, May 5-8, 2003, Houston, Texas, (2003), 10 pgs.
"Australian Application Serial No. 2011374305, Response filed Feb. 1, 2015 to Examination Report No. 1 mailed Sep. 30, 2014", 22 pgs.
"Australian Application Serial No. 2011374305, Patent Examiners Report No. 2 mailed Feb. 13, 2015", 4 pgs.
"Chinese Application Serial No. 201180072737.9, Office Action mailed Jan. 5, 2016", (w/ English Translation), 20 pgs.
"Mexican Application Serial No. MX/a/2014/001399, Office Action mailed Feb. 18, 2016", (w/ English Translation), 3 pgs.
"Mexican Application Serial No. MX/a/2014/001399, Response Apr. 19, 2016 to Office Action mailed Feb. 18, 2016", (English Translation of Amended Claims), 14 pgs.

* cited by examiner

APPARATUS AND METHOD OF LANDING A WELL IN A TARGET ZONE

RELATED APPLICATIONS

This application is a U.S. National Stage Filing under 35 U.S.C. 371 from International Application No. PCT/US2011/046389, filed on 3 Aug. 2011, and published as WO 2013/019223 A1 on 7 Feb. 2013, which application and publication are incorporated herein by reference in their entirety.

TECHNICAL FIELD

The present invention relates generally to apparatus for making measurements related to oil and gas exploration.

BACKGROUND

In drilling wells for oil and gas exploration, understanding the structure and properties of the associated geological formation provides information to aid such exploration. Optimal placement of a well in a hydrocarbon-bearing zone (the "payzone") usually requires geosteering with deviated or horizontal well trajectories, since most payzones extend in the horizontal plane. Geosteering is an intentional control to adjust drilling direction. An existing approach based on geosteering in well placement includes intersecting and locating the payzone followed by moving the drill string to a higher position and beginning to drill a new branch that approaches to the target zone from top. This first approach is time consuming, where drilling needs to be stopped and a device for branching needs to be lowered into the well. Another existing approach based on geosteering in well placement includes intersecting and locating the payzone followed by continuing drilling to approach the well from the bottom. This second approach can result in overshoot of the well path from the desired target zone and may only be effective if the well is highly deviated at point of intersection.

DETAILED DESCRIPTION

The following detailed description refers to the accompanying drawings that show, by way of illustration and not limitation, various embodiments in which the invention may be practiced. These embodiments are described in sufficient detail to enable those skilled in the art to practice these and other embodiments. Other embodiments may be utilized, and structural, logical, and electrical changes may be made to these embodiments. The various embodiments are not necessarily mutually exclusive, as some embodiments can be combined with one or more other embodiments to form new embodiments. The following detailed description is, therefore, not to be taken in a limiting sense.

In various embodiments, an ultra-deep sensing method is utilized that can optimally land a well in a target zone without branching and with reduced or no overshoot. Such a method can be realized using a deep-reading tool that can detect the boundary from a large enough distance so that it can approach the target with minimal or no overshoot. Minimal overshoot may include a distance less than 10% the vertical length of the target zone. In contrast, since standard logging tools can only detect an interface when it is at close proximity, a standard geosteering well trajectory may typically overshoot a target.

Figure 1:
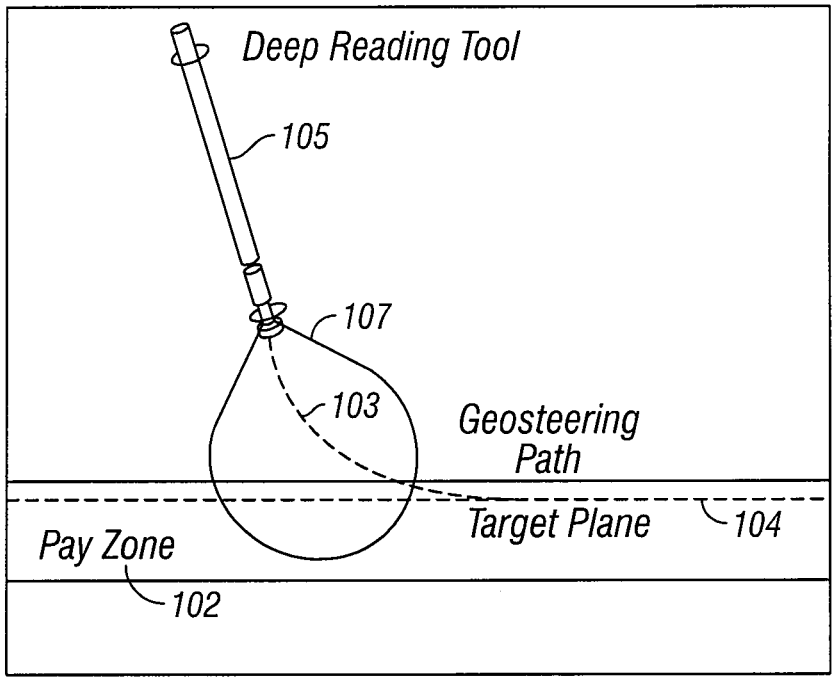
FIG. 1 depicts geosteering with a deep-reading tool, in accordance with various embodiments.

FIG. 1 depicts geosteering with a deep-reading tool 105. In this case, deep-reading tool 105 can be used with a processing unit to determine a target payzone in real-time with minimal a-priori information, to optimally geosteer the well into a target zone, to minimize drilling cost and time, to make deep readings of formation properties, or to accomplish one or more of these tasks. The control of the geosteering can be based on downhole logging measurements using deep-reading tool 105 to increase the borehole's exposure to the payzone. Such geosteering can be used to maintain a wellbore within a region that provides a material that is a source of economic value. Deep-reading tool 105 provides a signal having a probing region 107 that is relatively large compared with conventional tools. Processing the responses to probing signals provides for geosteering along geosteering path 103 to a target plane 104 in payzone 102. The relatively large probing region 107 allows a number of measurements to be taken while drilling, allowing multiple course corrections to be made to take geosteering path 103 in a locally optimal manner without, or with significantly reduced, overshoot in drilling.

Figure 2:
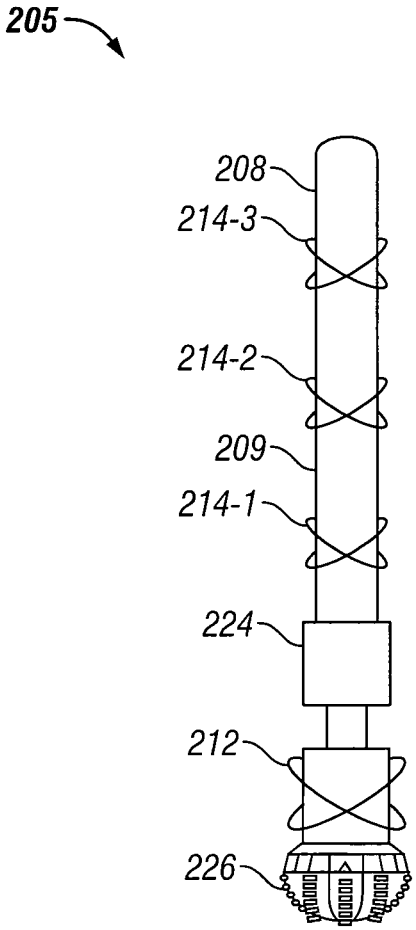
FIG. 2 shows an example of a tool structure for an electromagnetic application as a deep-reading tool, in accordance with various embodiments.

FIG. 2 shows an example embodiment of a tool structure 205 for an electromagnetic application as a deep-reading tool. Tool structure 205 includes transmitter sensor 212 and receiver sensors 214-1, 214-2, and 214-3 arranged such that there is a large separation between transmitter sensor 212 and receiver sensors 214-1, 214-2, and 214-3 that enables the tool to look a relatively large distance ahead of tool structure 205. For example, tool structure 205 can be arranged with a large separation between transmitter sensor 212 and receiver sensors 214-1, 214-2, and 214-3 selected to look 10 to 200 feet ahead of drill bit 226. The example tool of FIG. 2 shows tool structure 205 with transmitter sensor 212 located on drill bit 226, while receiver sensors 214-1, 214-2, and 214-3 are located on a drill collar 209 at drill-string 208. As a result, this configuration can maximize the transmitter-receiver spacing. The transmitters or receivers can be placed near the drill bit to make drilling decisions as soon as possible or close to the drill bit. Such placement allows a system to be able to look farther ahead of the drill bit. Transmitting or receiving sensors, such as transmitter antenna 212 and receiver sensors 214-1, 214-2, and 214-3, may be mounted outside drill collar 209, if drill collar 209 is made of conducting material, in order to facilitate the propagation of waves. It is also possible to place transmitting or receiving sensors inside drill collar 209 if non-conducting collar material or perforations are used for drill collar 209. Transmitting and receiving sensors, such as transmitter antenna 212 and receiver sensors 214-1, 214-2, and 214-3, can include induction type sensors such as coils or solenoids; electrode type sensors such as rings or buttons; toroidal sensors; acoustic type sensors such as bender-bar, magnetostrictive or piezo-electric sensors, or combinations thereof. Tool electronics are generally placed inside the collar. Transmitting or receiving sensors can be operated at low operating frequencies to minimize conduction losses. However, higher frequencies may be used with appropriate electronics to adjust for conduction losses. A tool structure as a deep reading sensor is not limited to example tool structure 205. Tool structure 205 can be used in a procedure identical to or similar to the geosteering in FIG. 1.

Figure 3:
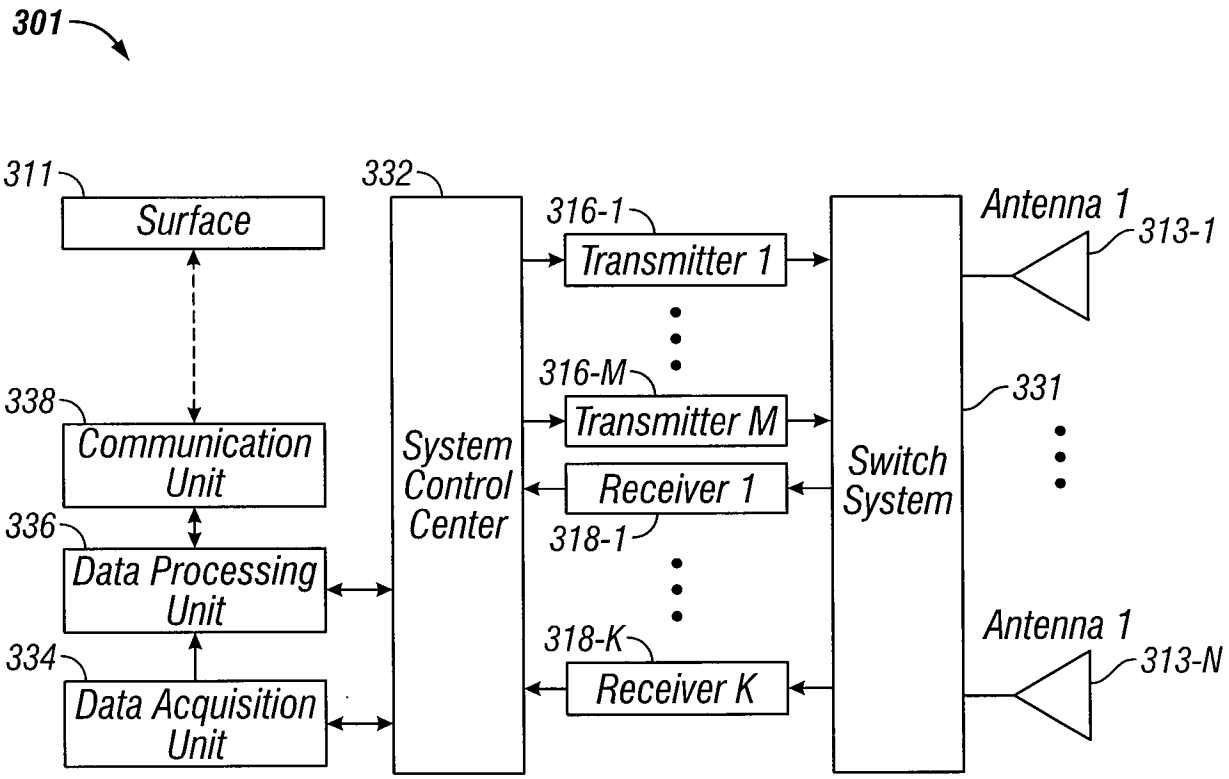
FIG. 3 shows a block diagram of example electronics of a deep-reading tool, in accordance with various embodiments.

FIG. 3 shows a block diagram of an example embodiment of a tool 301 having electronics associated with a deep-reading tool. Tool 301 includes a system control center 332, transmitters 316-1 . . . 316-M, receivers 318-1 . . . 318-K, transmitter and receiver antennas 313-1 . . . 313-N, a data acquisition unit 334, a data processing unit 336, and a communication unit 338. Communication unit 338 can include a telemetry unit for communication with surface 311. System control center 332 can be configured to handle the transmission of signals, reception of signals, and other processing operations. Transmitter and receiver antennas 313-1 . . . 313-N can be realized similar to or identical to transmitter sensor 212 and receiver sensors 214-1, 214-2, and 214-3 of FIG. 2. In general, there are N different antennas in example tool 301, while there are M different transmitters and K different receivers. A switch system 331 may facilitate the connection between antennas 313-1 . . . 313-N and transmitters 316-1 . . . 316-M and between antennas 313-1 . . . 313-N and receivers 318-1 . . . 318-K. Transmitters and receivers may share a single antenna, where, in such a case, the number of antennas, N, may be less than the sum of M and K. Tilted or multi-component antennas can be used for directional sensitivity. Rotation of the drill string on which tool 301 or portions of tool 301 is mounted may be utilized for further azimuthal sensitivity.

Tool 301 may operate in multiple frequencies to improve the sensitivity of the inversion of data to the desired properties of the formation in the direction ahead of drilling. Data obtained from the antennas are processed in the data processing unit 336 and sent to the system control center 332, where target detection and geosteering decisions can be made in real time. Data can also be communicated to surface 311 using communication unit 338, which may be accomplished with a telemetry unit. Communication to surface 311 provides the capability of real-time monitoring and human intervention in the geosteering process. Alternatively, data processing may be performed at surface 31 land system commands based on this processed data may be conveyed to system control center 332 using communication unit 338. Such system commands can include, but are not limit to, commands for geosteering.

Signals are acquired at one or more of receivers 318-1 . . . 318-K as a result of transmitting signals at one or more of antennas 313-1 . . . 313-N and receiving signals at one or more of antennas 313-1 . . . 313-N from the formation layers in the region probed by the transmitted signals. The received signals from the formation layers depend on the properties of the formation layers and the arrangement of antennas 313-1 . . . 313-N relative to the formation layers probed. The signals acquired at receivers 318-1 . . . 318-K may be in the form of voltage signals. Voltage at receivers 318-1 . . . 318-K can be correlated as functions of the horizontal resistivity ($R_h$) and vertical resistivity ($R_v$) of the formation layers, distance (d) of the tool to the target plane, dip angle ($\theta$) between the tool axis and normal of the target plane, and azimuth ($\Phi$) of the tool with respect to the target plane. Additional parameters may also be considered in more complicated formation models without any loss of generality for a process that includes activating one or more antennas, collecting signals in response to the activation, inverting the data from the collected signals, and performing drilling related operations such as, but not limited to, geosteering based on the results of inverting the data. Herein, inverted data means the results of inverting data, that is, converting measured data into information correlated to features related to formation layers. In such a process, performing drilling related operations, including geosteering, based on the inverted data can be performed autonomously by operation of the tool according to a set of rules stored in the electronics associated with the tool. For clarity purposes, operational features of such a process can be viewed as two different operational modes. A first mode includes operational activities taken before the determination of a target. A second mode includes operational activities taken after the determination of a target.

Figure 4:
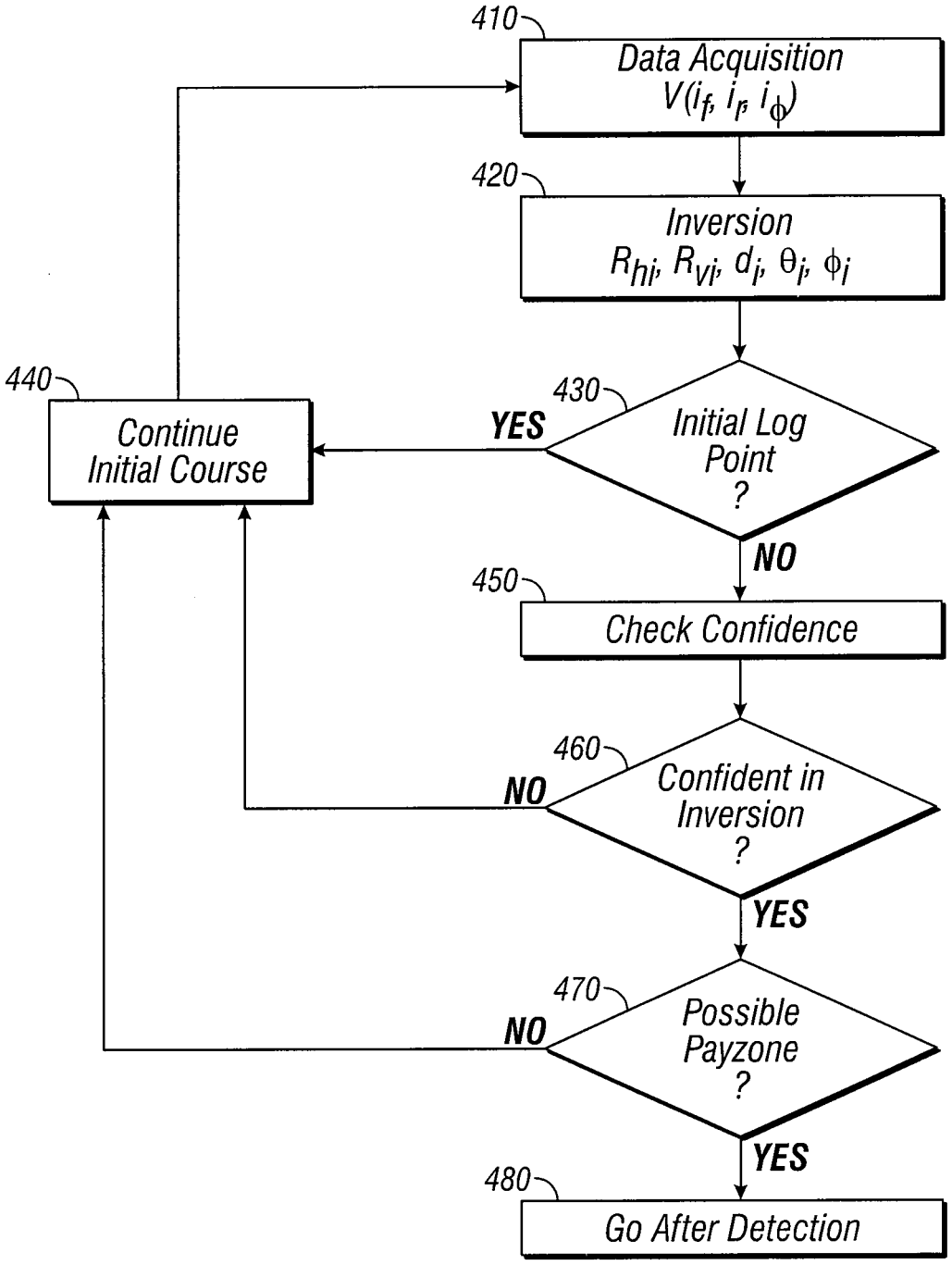
FIG. 4 shows features of an example method of conducting tool operations correlated to a drilling operation before a target is detected, in accordance with various embodiments.

FIG. 4 shows features of an example embodiment of a method of conducting tool operations correlated to a drilling operation before a target is detected. The method of FIG. 4 can be performed, but is not limited to, using the tool of FIG. 3, which may include tool structures similar or identical to tool structures 105 and 205 of FIGS. 1 and 2, respectively. The tool of FIG. 3, having multiple receiving sensors, can provide for collection of multiple data points at one or more data acquisition points in the procedure. At 410, data is gathered at a log point and passed to data processing unit 336. The data may be provided as a matrix of different frequencies ($i_f$) and transmitter-antenna pairs ($i_r$). It can also contain azimuthal bins ($i_\Phi$) as the tool 301 rotates around the axis of the structure on which it is mounted. In some implementations of the method, log points that are close in time and space may be averaged to reduce noise.

At 420, in data processing unit 336, data can be inverted for the parameters considered in a formation model. Inversion can be realized using a forward model for the tool. A forward model provides a set of mathematical relationships for sensor response that can be applied to determining what a selected sensor would measure in a particular environment, which may include a particular formation. A library can include information regarding various formation properties that can be correlated to measured responses to selected probe signals. Performing an inversion operation or inversion operations can include performing an iterative process or performing a pattern matching process. The forward model and/or library can be stored in the same machine-readable medium device, different machine-readable media devices, or distributed over machine-readable media system at different locations. The instructions in the machine-readable media device or the machine-readable media system can include instructions to perform an inversion operation or inversion operations by performing an iterative process or performing a pattern matching process.

A result of inversion can be a parameter set that minimizes the error between the measured voltage and a forward response of the forward model. A Levenberg-Marquardt method can be used to obtain a desired set of results. The Levenberg-Marquardt method is a standard iterative technique for addressing non-linear least-squares problems, where the technique is used to locate the minimum of a multivariate function that is expressed as the sum of squares of non-linear real-valued functions. This method can be viewed as a combination of a steepest descent method and a Gauss-Newton method. The inversion process is not limited to using the Levenberg-Marquardt method, other techniques may be used for inversion. For a formation model, inverted parameters for each layer, i, can include horizontal resistivity ($R_{hi}$) and vertical resistivity ($R_{vi}$) of the layer, distance ($d_i$) to the target plane, dip angle ($\theta_i$) between the tool axis and the normal of the target plane, and dip azimuthal angle ($\Phi_i$).

Since electronic and environmental noises can corrupt the data, and due to sensitivity of the inversion results to noise, inverted parameters may be quite different from the real formation parameters. Hence, the accuracy of the inversion can be subjected to verification before it can be used in geosteering decisions. In various embodiments, confidence in the inverted parameters can be estimated. At 430, if the data gathering operation is just initialized and if is the initial inversion action, the drilling operation of the well continues in its initial course, at 440, and a second set of data is measured at another log point, at 410. This second data is inverted, at 420, and the results are compared to those of the previous inversion, at 450 to check confidence of the inverted data. Prior to this comparison, parameters of the previous inversion that are position dependent, such as distance to target plane ($d_i$) and dip angle ($\theta_i$), may be updated to compensate for the well movement data acquisition points. However, this may not be necessary if the drilling of the well moves a negligible distance between two log points and the change is small when compared to the threshold limits used in comparing the two successive inversions. If the two inversions produce results that are relatively close to each other with respect to a given threshold, results are deemed confident and the algorithm proceeds with analyzing the inverted data with respect to a payzone, at 470. More than two inversion results may be compared. The confidence verification can include processing unit 336 configured to analyze residual errors associated with the inversion step. The confidence verification can include comparing received voltage values. The confidence verification can include comparing an algebraic function of the received voltage values with respect to each received voltage value or an estimated value. The confidence verification can include performing various combinations of the processing discussed herein. Optimal confidence estimation may depend on the type of noise and the type of formation being investigated. If the confidence in the inversion is below a set threshold, the drilling operation can continue its course, at 440, making another data acquisition, at 410, which is subjected to inversion and verification of the confidence in the newly generated inversion data.

At 470, once the confidence in inversion is obtained, a determination can be made in tool 301, for example, as to whether the formation has the desired properties based on the inverted parameters. For example, hydrocarbon content may be the property of interest. Alternatively, other properties may be of interest in the examination to identify underground regions to be avoided by geosteering. If inversion result matches the desired feature, a target plane can be determined based on the inverted parameters. For example, in the case of a water to oil interface, target may be set to a plane that is parallel and at a distance to the water-oil interface inside the oil-bearing zone. If the inverted result does not match the desired characteristic, the well continues on its original course, at 440, and the above steps (410-470) are repeated until a desired target is obtained.

When a target is determined, the drilling of the well can be steered toward the target in an optimal course. The optimal course is defined as the path that minimizes the distance at which the well is parallel and in the target plane. The optimal course may at all times satisfy a dogleg criteria, which puts a limit on the maximum angle that can be produced in a given distance. Typical dogleg paths are around 10° per 100 feet. This number may vary significantly based on available technology and properties of the formation. In the case of the above two conditions, calculation of this optimal course involves solution of a geometric problem involving circles and lines, which is straight forward and as a result is not included here. However, in different geosteering conditions, a different optimum course calculation may be used, which can involve an iterative solution.

Figure 5:
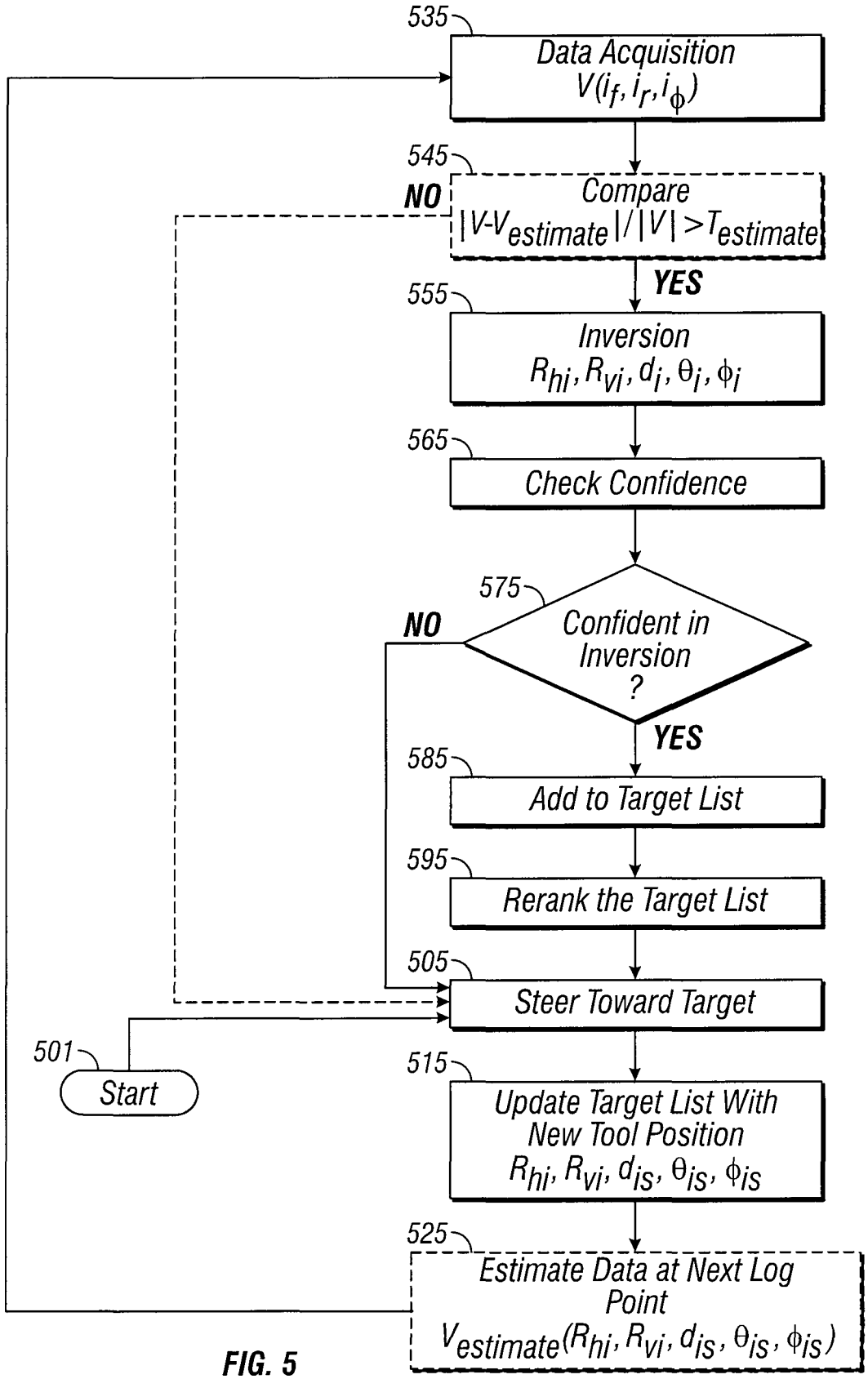
FIG. 5 shows features of an example embodiment of a method of conducting tool operations correlated to a drilling operation after a target is detected, in accordance with various embodiments.

FIG. 5 shows features of an embodiment of an example method of conducting drilling operations after a target is detected. As discussed above with respect to FIG. 4, starting, at 501, as the well is steered toward the target at 505, position dependent parameters of the inversion are updated, at 515. At 525, a data estimate at the next log point, based on these updated parameters, can be generated using a forward model, for example generating a voltage estimate, $V_{estimate}$. After generation of the data estimate, data acquisition can be performed, at 535, followed by inversion, at 555, using the acquired data. Since inversion may involve a large number of parameters, it may take considerable amount of processor time and may not be feasible to perform at every log point in a downhole data processing unit or a surface data processing unit. In order to minimize the number of time-consuming inversion operations, necessity of inversion can be tested at each step. At 545, if the measured data is close to the estimate of 525, the previous inversion result is deemed accurate and no inversion is performed. After the data is inverted, at 565, the confidence of results of this new inversion is tested. This confidence calculation is similar to that discussed with respect to FIG. 4. If confidence is not satisfied, the steering continues toward the target and the data acquisition and processing continues. If confidence is satisfied, determined parameter estimates are added to a target list, at 585. Then, at 595, each item in this list is ranked (assigned points) or re-ranked to determine the one that may be the most accurate.

Figure 6:
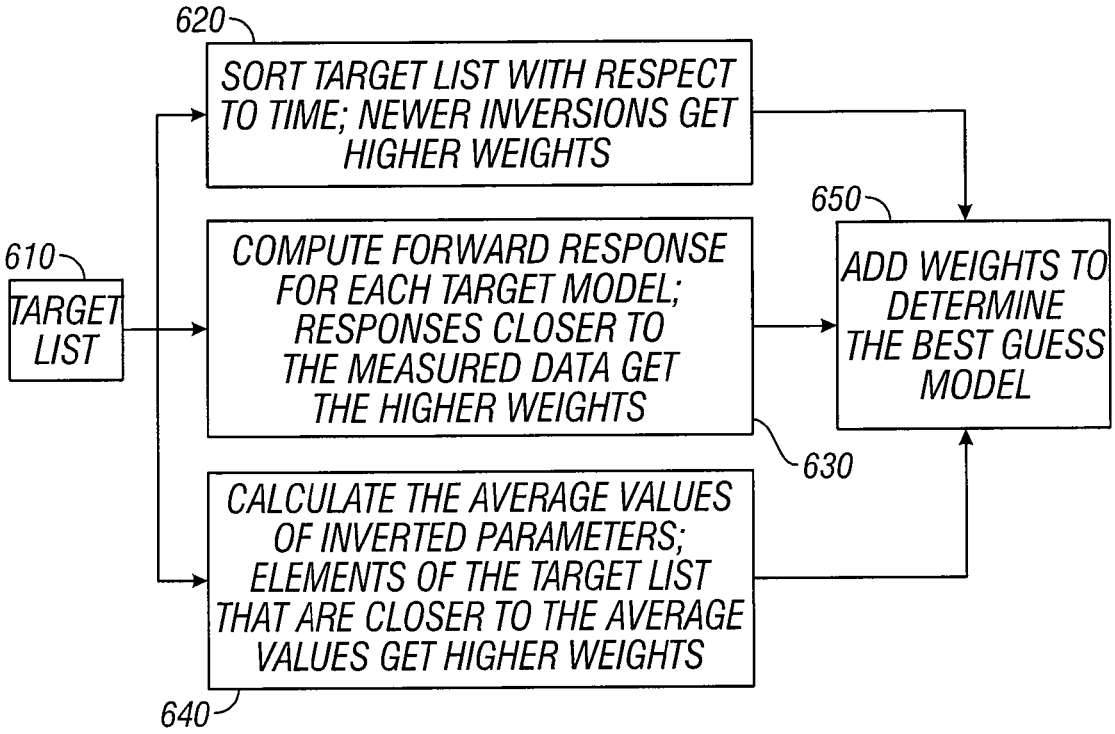
FIG. 6 shows features of an example method of using ranking of a target list to direct geosteering, in accordance with various embodiments.

FIG. 6 shows features of an example embodiment of a method of using ranking of a target list 610 to direct geosteering. Multiple data acquisitions can be conducted at a log point or within a short distance of the log point using multiple receiving sensors identical to or similar to the receiving sensors of FIG. 2. At 620, the list of possible targets can be sorted in order of the time they are obtained. Newer estimates are given higher weights, since errors in target location for older estimates are generally higher. Typically, the only exception is the overshoot situation where older estimates may be more accurate than the newer ones. At 630, using the forward model, elements of the list that produce values that are closer to the measured data are given higher weights. At 640, estimates can also be sorted according to their distance to the rest of the estimates. A mean or median of the estimates may be used for this purpose. Higher weights are given to the estimates that are closer to the average values. Thus, this procedure can be used to eliminate outlier estimates. The target list may be ranked according to how well the inverted parameters predict the measured data. At 650, results of these different steps (620, 630, and 640) can be combined and the element of the list with the highest overall weight can be chosen as the best target estimate. The order of the activities 620, 630, and 640 can be conducted in any order. In various embodiments, the ranking algorithm may include a subset of activities 620, 630, and 640 without performing all activities 620, 630, and 640. Additional procedures for optimization of the ranking algorithm can be conducted.

After the ranking of the items in the target list, the well can be steered toward the location of the target estimate that is deemed most accurate. If no inversion is performed, the well can be steered towards the target used in the previous step. The target list can be updated to account for the change in tool's position, that is, updated values for the distance to the target $d_{is}$, dip angle $\theta_{is}$ and dip azimuthal angle $\Phi_{is}$ are calculated for the model. After the updating is completed, the above processing activities can be repeated until the well is placed in the target plane. The well may be steered after it reaches the target plane using the above processing activities to ensure that the well does not deviate from its path and stays within the payzone. The combination of the acquisition tool structure and the processing of the acquired data can provide for functioning as a proactive steering tool. Even though the target is described herein as a plane, it may consist of other shapes and data processing in accordance with the teachings herein, can be straightforwardly extended to targets having shapes other than a plane.

In various embodiments, a method is provided that is capable of detecting a target payzone in real-time by calculating an optimal path to a target and landing the well to the desired target zone with minimum drilling time. Such a procedure is cost effective since it does not require any auxiliary information from reference wells, or any prior intersection with the target well. As a result, this procedure can decrease the total drilling distance and time by eliminating or minimizing the overshoot of the target location. Reductions in the overshoot by at least 100 feet may be obtained. The method can be applied where the well is deviated.

Figure 7:
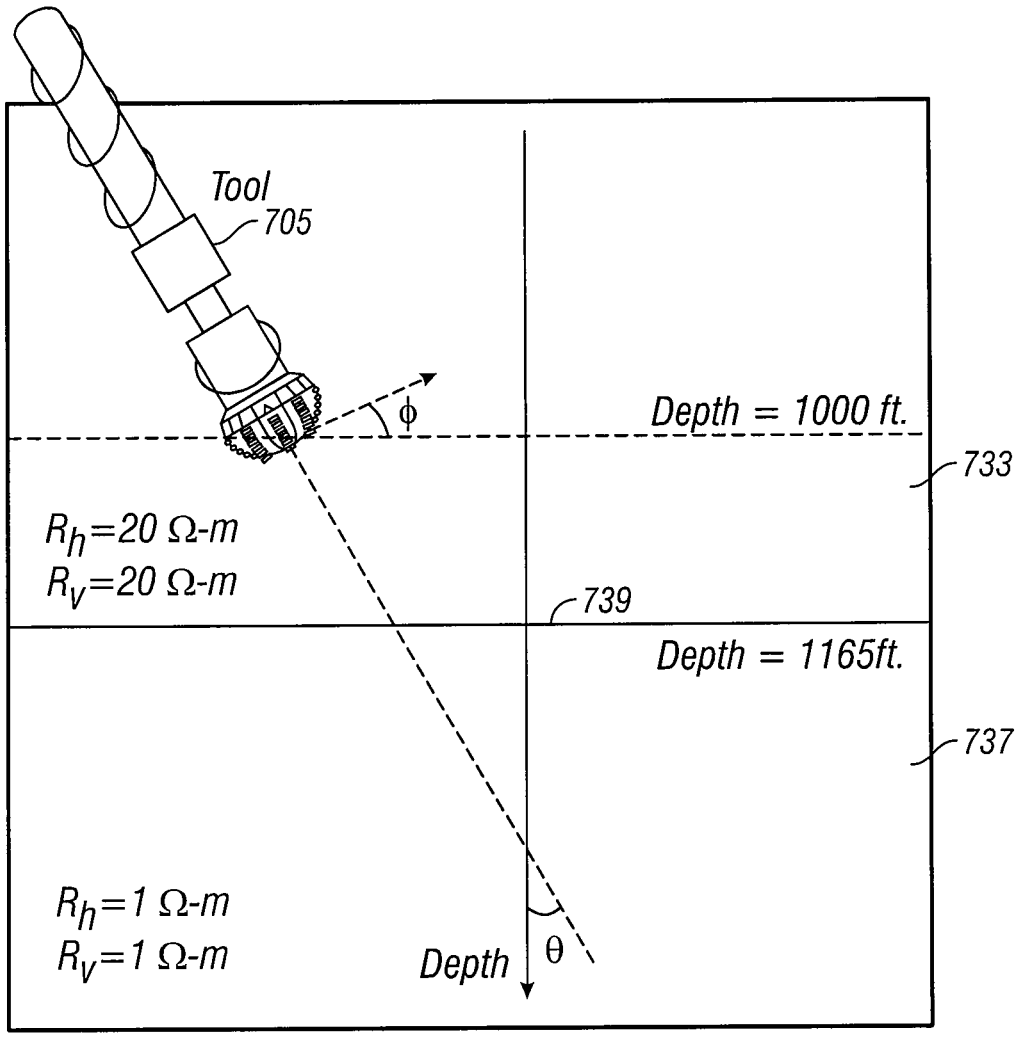
FIG. 7 shows an example formation geometry used in simulations of a deep-reading tool, in accordance with various embodiments.

FIG. 7 shows an example formation geometry used in the simulations of a deep-reading tool. The higher depth of investigation of deep-reading tool 705, having a configuration similar to or identical to deep-reading tool 105 of FIG. 1 and/or similar to or identical to deep-reading tool 205 of FIG. 2, can be illustrated by comparing simulation results with an electromagnetic tool having a lower depth of investigation that is in contemporary use. To accomplish this, a deep-reading tool 705 with a much longer transmitter-receiver spacing can be compared with an azimuthal deep resistivity (ADR) tool. The depth axis is in the direction of the true vertical with respect to earth, increasing downward. The well is taken to be inside an isotropic resistive layer 733 with a resistivity of 20 Ω-m, and it is being drilled towards an interface 739 to a less resistive layer 737. This second layer 737 is also isotropic with a resistivity of 1 Ω-m. For illustration purposes, a target plane is chosen at 5 ft away from the boundary, inside the resistive layer 733 at a depth of 1160 ft. Tool 705 can be represented by a tool model having a transmitter with a magnetic moment parallel to its tool axis and located on the drill bit. There are three receiver antennas in the model, similar to FIG. 2. All three receiver antennas are tilted at an angle of 45° and they are at a distance of 25 ft., 37.5 ft., and 50 ft. from the transmitter, respectively. This tool model was selected as a multi-frequency system operating at the frequencies of 500 Hz, 2 kHz, 6 kHz, and 18 kHz. Dip azimuth angle was taken as 15°. Simulations started with the transmitter at 1000 ft. Maximum geosteering rate of the tools was taken as 10° deviation in 100 ft. Relative dielectric permittivity and relative magnetic permeability of the media of layers 733 and 737 were taken as unity. A multiplicative noise with uniform distribution was added to the signal in the simulations. Peak value of the noise is selected to be 0.5% of that of the signal.

Figure 8:
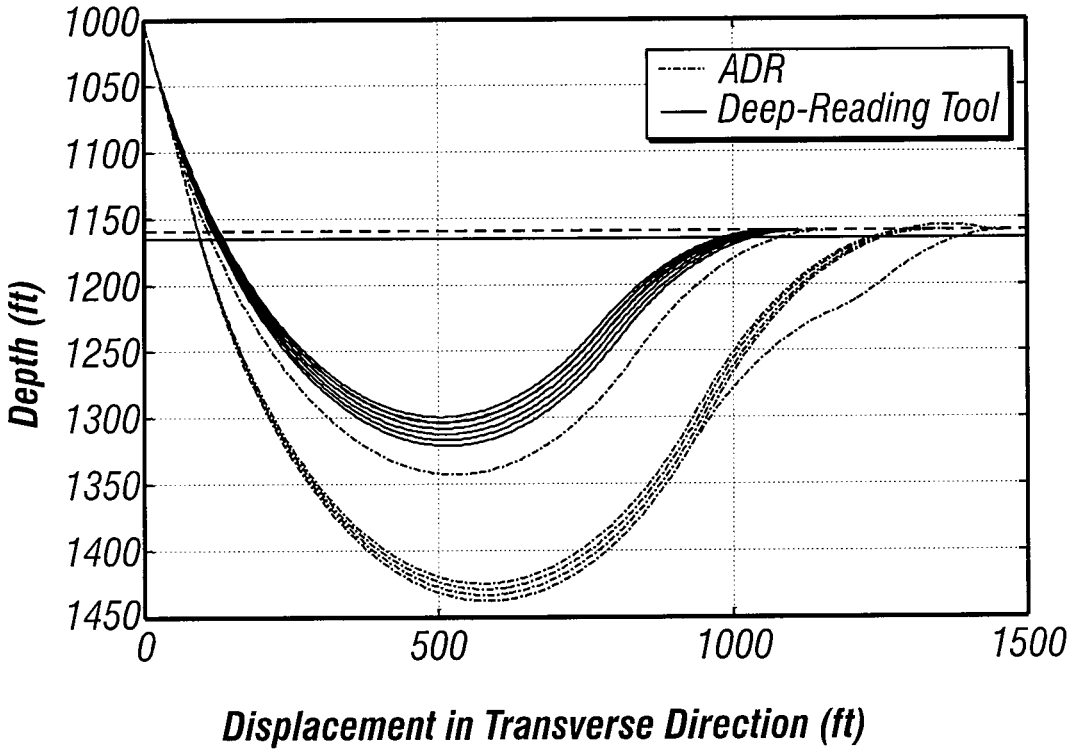
FIG. 8 shows, for well trajectories of thirty degrees, a comparison of results from an azimuthal deep resistivity tool with results from a deep-reading tool, in accordance with various embodiments.

FIG. 8 shows, for well trajectories of thirty degrees, a comparison of results from an ADR tool with results from a deep-reading tool. In the simulation, well trajectories of thirty degrees means that the initial dip angle was taken as θ=30°. The abovementioned method discussed with respect to FIGS. 4-6 was applied to both the well with the ADR tool and the well with the deep-reading tool. Simulations were repeated 10 times for both cases to account for the randomness of the noise. Results show that the method can be successfully used for landing on the target plane with a traditional tool like an ADR tool, but the greatest benefit is observed when using a deep-reading tool. On average, the deep-reading tool begins to see the target zone at a distance of 140 ft. from the boundary, compared to approximately 20 ft. for that of the ADR tool. As a result, overshoot is decreased by about 120 ft. and the total horizontal drilling distance is reduced by approximately 500 ft.

Figure 9:
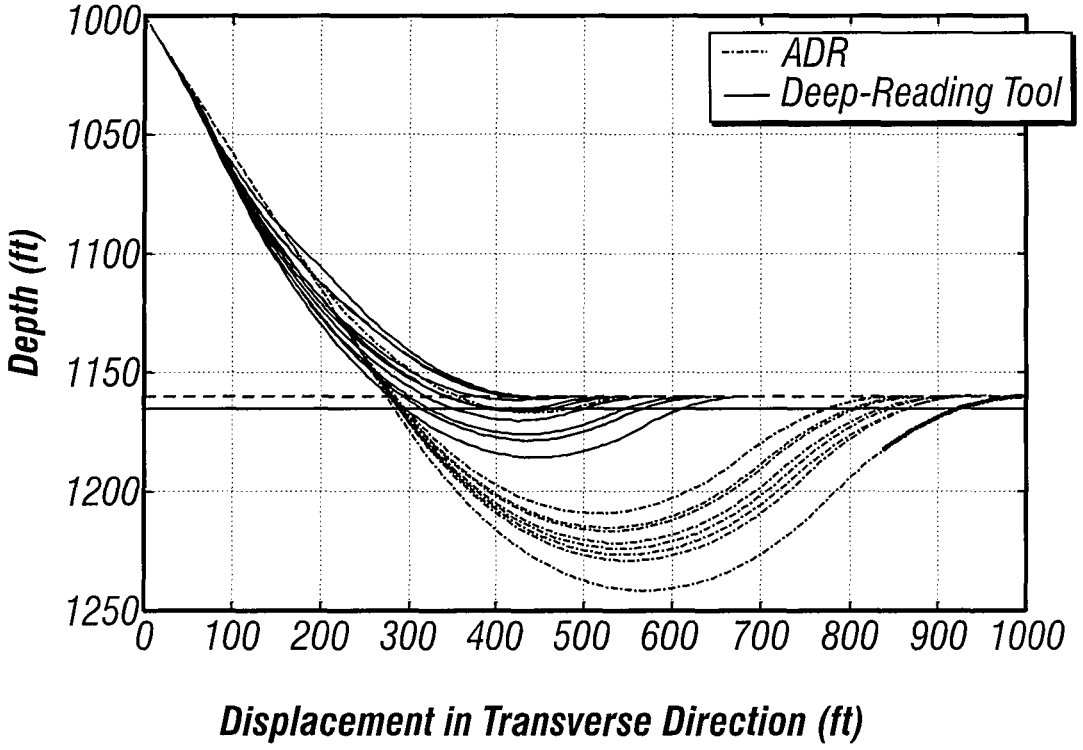
FIG. 9 shows, for well trajectories of sixty degrees, a comparison of results from an azimuthal deep resistivity tool with results from a deep-reading tool, in accordance with various embodiments.

FIG. 9 shows, for well trajectories of initial dip angle equal to sixty degrees, a comparison of results from an azimuthal deep resistivity tool with results from a deep-reading tool. The method discussed with respect to FIGS. 4-6 was again applied. Such a method is able to geosteer the well with the deep-reading tool to the target zone with little or no overshoot, while the well with the ADR tool overshoots the target by approximately 70 ft on average and total horizontal drilling distance is increased by approximately 350 ft. Results of the simulations demonstrate that the method, as taught herein, can be successfully applied to detect a target zone in real time with no a-priori information, that geosteering to the target zone and horizontal placement of the wells can be successfully performed, and that the method is most beneficial when it is applied using a tool with a high depth of investigation. At a high depth of investigation, the well may be geosteered to the payzone with little or no overshoot. As a result, drilling time and costs are minimized.

Figure 10:
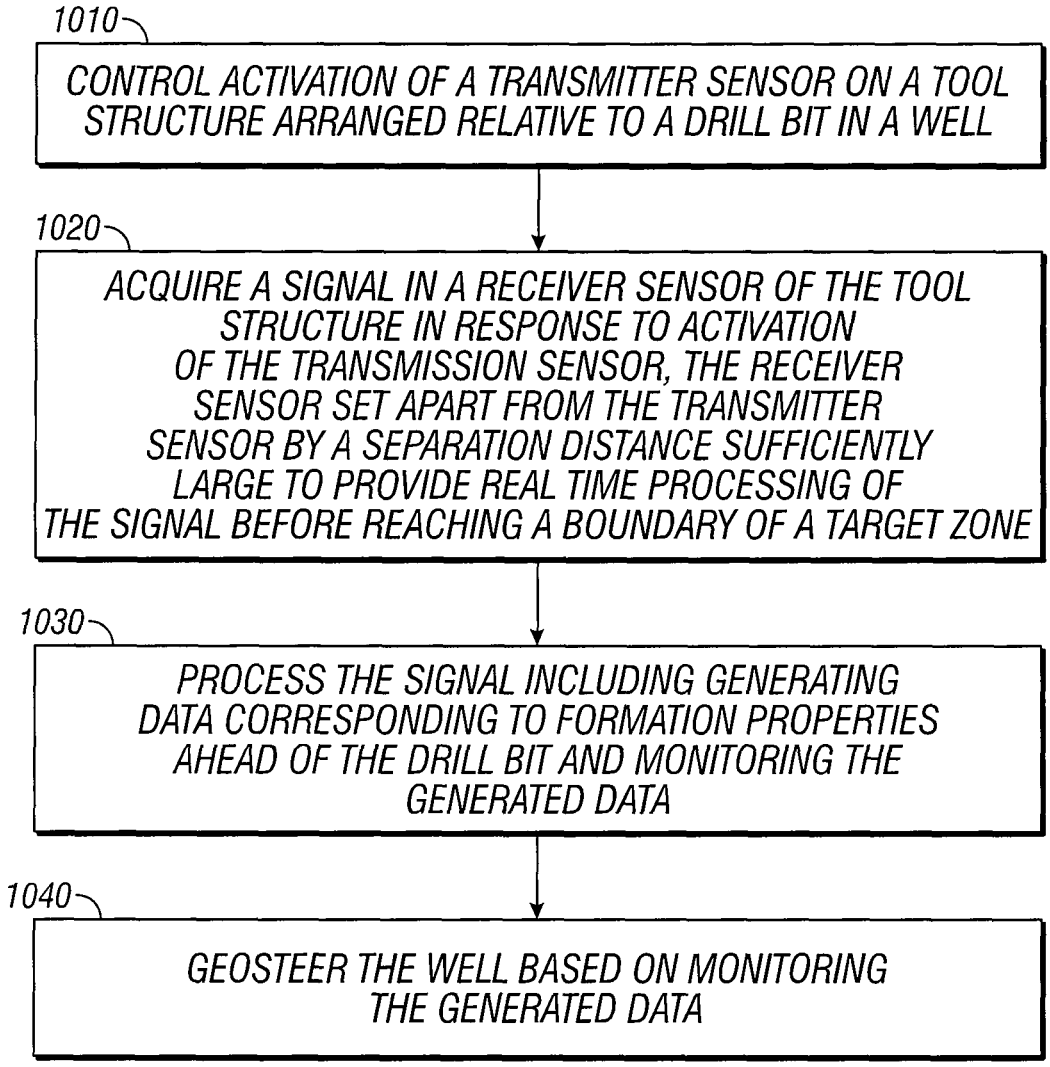
FIG. 10 shows features of an example method of landing a well in a target zone, in accordance with various embodiments.

FIG. 10 shows features of an embodiment of an example method of landing a well in a target zone. At 1010, a transmitter sensor on a tool structure arranged relative to a drill bit in a well is activated. At 1020, a signal is acquired in a receiver sensor of the tool structure in response to activation of the transmitter sensor. The receiver sensor can be set apart from the transmitter sensor by a separation distance sufficiently large to provide real time processing of the signal before reaching a boundary of a target zone in a drilling operation. This separation distance allows a probe signal be generated from the transmitter sensor ahead of a drill bit and signals from the formation generated in response to the probe signal to be collected and processed such that course corrections to the drilling can be made during the drilling process. Additional receiver sensors can be arranged on the tool structure with the transmitter sensor set apart from the transmitter by a separation distance that is sufficiently large to provide real time processing of the signal before reaching a boundary of a target zone in a drilling operation. The transmitter sensor or sensors and the receiver sensor or sensors can be arranged along axis of the tool structure similar to or identical to an embodiment of such a tool structure disclosed herein.

At 1030, the signal is processed. The processing can include generating data corresponding to formation properties ahead of the drill bit and monitoring the generated data. The processing can be conducted in real time during a drilling operation. Generating data corresponding to formation properties can include conducting an inversion operation with respect to the acquired signal. The results of the inversion operation can include one or more of a horizontal resistivity of a formation layer, a vertical resistivity of the formation layer, a distance of the drill bit to the target, a dip angle between an axis of the tool structure and a normal to the target, or an azimuth of the tool structure with respect to the target. The results of the inversion can be verified such that verifying accuracy of results of the inversion operation is conducted before using the results of the inversion operation to geosteer the well. An example verification process may include comparing the results of two inversion operations such that the difference between the two inversion operations being less than a set threshold value indicates a confidence level to continue along a path to the target.

The inversion operation can be conducted by applying a Levenberg-Marquardt technique with respect to the acquired signal. Other techniques can be implemented. Conducting the inversion operation can include generating a parameter set that minimizes error between measured voltage and a forward response of a forward model. The measured voltage corresponds to a received signal at a receiver sensor of the tool structure generated ahead of a drill bit in response to a signal sent from a transmitter sensor of the tool structure. A parameter set can be generated at each logging point of the drilling operation or at less than each logging point depending on the difference between received signals at consecutive logging points. The process of landing a well at a target in a target zone can be conducted in an iterative manner with the target and target zone predetermined. Alternatively, the process can include iteratively controlling activation of the transmitter sensor, acquiring a signal corresponding to the activation, and processing the acquired signal to identify the target or the target payzone. The identification process can include comparing the results of the inversion process with properties of a desired target zone that are stored in memory. The use of the transmitter sensors and receiver sensors set apart as deep-reading sensors provides a capability to identify regions to avoid in the identified target zone and to set a target in the target zone that avoids such regions.

At 1040, the well is geosteered based on monitoring the generated data. In various embodiments, monitoring the generated data can include comparing the generated data with previously generated data. The geosteering of the well can be based on comparing the generated data with previously generated data. The geosteering can direct the drilling of the well such that the well approaches a target in the target zone with minimal or no overshoot of the target zone. Geosteering the well includes directing drilling of the well to the target identified as a target plane in the target zone. The target is not limited to a target plane, the target may have other shapes. The shape may depend on structures in the formation layers of the target zone that are to be intentionally avoided. The geosteering may be conducted along a course according to a dogleg criteria. Various dogleg criteria can be set. For example, the dogleg criteria may include a maximum angle of around 10° per 100 feet.

The geosteering process using deep-reading sensors can be conducted in an iterative manner in which optional activities can be conducted during an iteration. For example, the process can include skipping an inversion activity in an iteration. The procedure, with the inversion skipping option, can include repeating controlling activation of the transmitter sensor, acquiring a signal corresponding to the activation, processing the acquired signal to generate inverted data, and geosteering the well in an iteration process such that the iteration process provides for detection of the target or geosteering to the target. The procedure can include generating, for a next signal to be acquired, an estimated signal value from processing a last signal processed. The next signal can be acquired and a measured signal value of the next signal can be generated. If a difference between the estimated signal value and the measured signal value is within a threshold value, the data processing unit can refrain from processing, for example inverting, this acquired next signal and accept the inverted data generated from the last signal processed as accurate. Generating the estimated signal value for the next signal to be acquired can include using a forward model. The forward model used can be the forward model used in the inversion operation to generate the inverted data from the last signal.

In various embodiments, a method to land a well directed to a target in a target zone can also include repeating controlling activation of the transmitter sensor and acquiring a signal corresponding to the activation at different log points during drilling the well; performing a confidence process on inverted data generated from acquired signals correlated to one or more of the log points; adding, to a target list, inverted data that satisfied the confidence process or parameters generated from the inverted data that satisfied the confidence process; ranking the target list; and geosteering toward the target based on the ranked target list. In an iterative process, ranking elements of the target list can include re-ranking elements of the target list based on updated parameters. Ranking the target list can include sorting the target list with respect to the time that the inverted data is generated. Sorting the target list with respect to time can include applying weights to the elements of the target list such that higher weights are applied to most recently generated inverted data. Ranking the target list can include computing forward responses for a number of target models and applying weights according to a difference between each forward response and its corresponding measured response such that, the smaller the difference, the higher is the weight assigned. Ranking the target list includes calculating average values of the inverted data in the target list, and applying weights to the inverted data according to a difference between the inverted data in the target list and the average values of the inverted data such that, the smaller the difference, the higher is the weight assigned.

Ranking a target list can include combining one or more different ranking procedures using generated weights in these procedures. For example, ranking the target list can include sorting the target list with respect to the time that the inverted data is generated and applying a time weight such that a higher time weight is given to most recently generated inverted data; computing forward responses for a number of target models and applying response weights according to a difference between each forward response and its corresponding measured response such that, the smaller the difference, the higher is the response weight assigned; and calculating average values of the inverted data in the target list and applying averaged value weights to the inverted data according to a difference between the inverted data in the target list and the average values of the inverted data such that, the smaller the difference, the higher is the averaged value weight assigned. The time weight, the response weight, and the averaged value weight can be added for each element in the target list to determine a model from which to geosteer. In addition, after reaching the target, where the target has a shape in the target zone, the method of geosteering can include repeating controlling activation of the transmitter sensor and acquiring a signal corresponding to the activation at different log points during drilling the well; performing a confidence process on inverted data generated from acquired signals correlated to one or more of the log points; and geosteering the well along the shape of the target.

Figure 11:
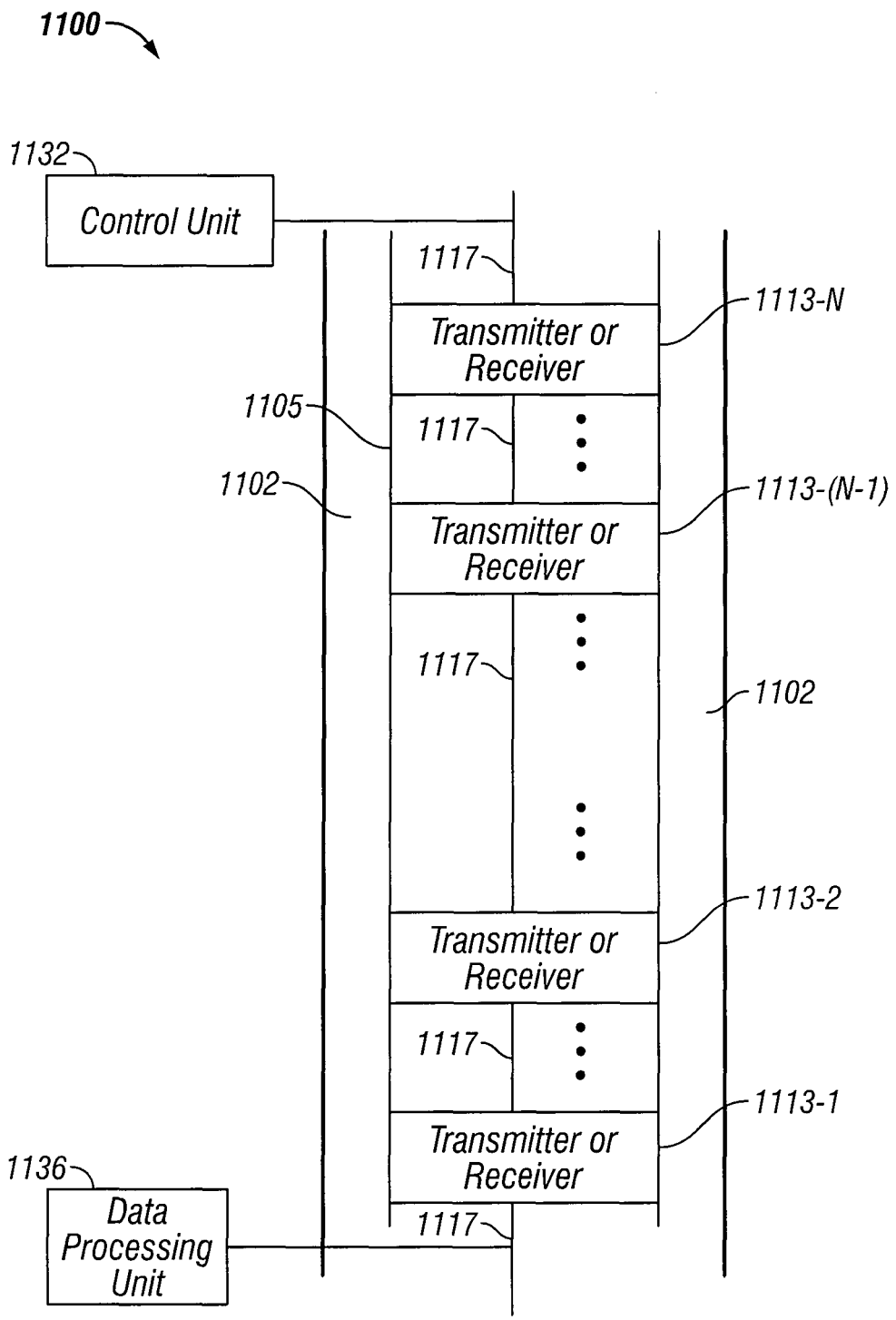
FIG. 11 shows a block diagram of an example apparatus to land a well directed to a target in a target zone using deep-reading sensors, in accordance with various embodiments.

FIG. 11 shows a block diagram of an embodiment of an apparatus 1100 to land a well directed to a target in a target zone using deep-reading sensors. Apparatus 1100 includes a tool structure 1105 having an arrangement of sensors 1113-1, 1113-2 . . . 1113-(N−1), 1113-N along a longitudinal axis 1107 of tool 1105. Each sensor 1113-1, 1113-2 . . . 1113-(N−1), 1113-N can be utilized as a transmitting sensor or a receiving sensor under the control of control unit 1132. Control unit 1132 is operable to select one or more transmitter sensors from among the sensors in the arrangement of sensors 1113-1, 1113-2 . . . 1113-(N−1), 1113-N and to select one or more receiver sensors from among the sensors in the arrangement of sensors 1113-1, 1113-2 . . . 1113-(N−1), 1113-N such that the selected receiver sensor is set apart from the selected transmitter sensor by a separation distance that is sufficiently large to enable a signal acquired at the selected receiver sensor, in response to activating the selected transmitter sensor, to be processed in real time during a drilling operation before the well reaches the boundary of a target zone. The arrangement of sensors 1113-1, 1113-2 . . . 1113-(N−1), 1113-N include, but is not limited to, an arrangement of tilted antennas. For arrangements in which sensors 1113-1, 1113-2 . . . 1113-(N−1), 1113-N are tilted, each tilted sensor can be arranged with respect to longitudinal axis 1117. However, sensors 1113-1, 1113-2 . . . 1113-(N−1), 1113-N can be arranged other than with respect to longitudinal axis 1117. Having a large separation distance between selected transmitting sensor and selected receiver sensor allows for collection of formation data far ahead of the drilling operation. For a given separation distance, the deep-reading distance is largest for a transmitting sensor disposed on the drill bit for the drilling operation. Sensors 1113-1, 1113-2 . . . 1113-(N−1), 1113-N and the arrangement of sensors 1113-1, 1113-2 . . . 1113-(N−1), 1113-N can be realized, for example, similar or identical to the sensors and the deep-reading arrangement associated with FIGS. 1-10, 12, and 13. Sensors 1113-1, 1113-2 . . . 1113-(N−1), 1113-N and the arrangement of sensors 1113-1, 1113-2 . . . 1113-(N−1), 1113-N can be implemented in measurements-while-drilling (MWD) applications such as a logging-while-drilling (LWD) applications.

Apparatus 1100 can include a control unit 1132 that manages the generation of transmission signals and the collection of received signals corresponding to the transmission signals. The generation of transmission signals can be conducted to provide signals of different frequencies. The collected received signals can be provided to a data processing unit 1136 in appropriate format to perform inversion on data generated from signals acquired at receiving antennas in the arrangement of sensors 1113-1, 1113-2 . . . 1113-(N−1), 1113-N. Data processing unit 1136 can be structured to utilize a forward model to perform the inversion on data generated from signals acquired at receiving antennas. Data processing unit 1136 can be structured to provide formation properties and data identifying the position of the drilling operation, which can be correlated to the position of the drill bit, relative to a target in a target zone for drilling using iterative processing. Pattern matching processes may also be employed. Data processing unit 1136 can be arranged as a separate unit from control unit 1132 or integrated with control unit 1132. Control unit 1132 and data processing unit can be realized, for example, similar or identical to the control units and data processing units associated with FIGS. 1-10, 12, and 13.

Various components of a system including a tool, having one or more sensors operable with transmitting positions and receiving positions separated by relatively large distances, and a processing unit, as described herein or in a similar manner, can be realized in combinations of hardware and software based implementations. These implementations may include a machine-readable storage device having machine-executable instructions, such as a computer-readable storage device having computer-executable instructions, to control activation of a transmitter sensor on a tool structure arranged relative to a drill bit in a well; acquire a signal in a receiver sensor of the tool structure in response to activation of the transmitter sensor, where the receiver sensor is set apart from the transmitter sensor by a separation distance sufficiently large to provide real time processing of the signal before reaching a boundary of a target zone; process the signal including generating data corresponding to formation properties ahead of the drill bit and monitoring the generated data; and geosteer the well based on monitoring the generated data such that the well approaches a target in the target zone with minimal or no overshoot of the target zone. The instructions can include instructions to operate a tool and a geosteering operation in accordance with the teachings herein. Further, a machine-readable storage device, herein, is a physical device that stores data represented by physical structure within the device. Examples of machine-readable storage devices include, but are not limited to, read only memory (ROM), random access memory (RAM), a magnetic disk storage device, an optical storage device, a flash memory, and other electronic, magnetic, and/or optical memory devices.

Figure 12:
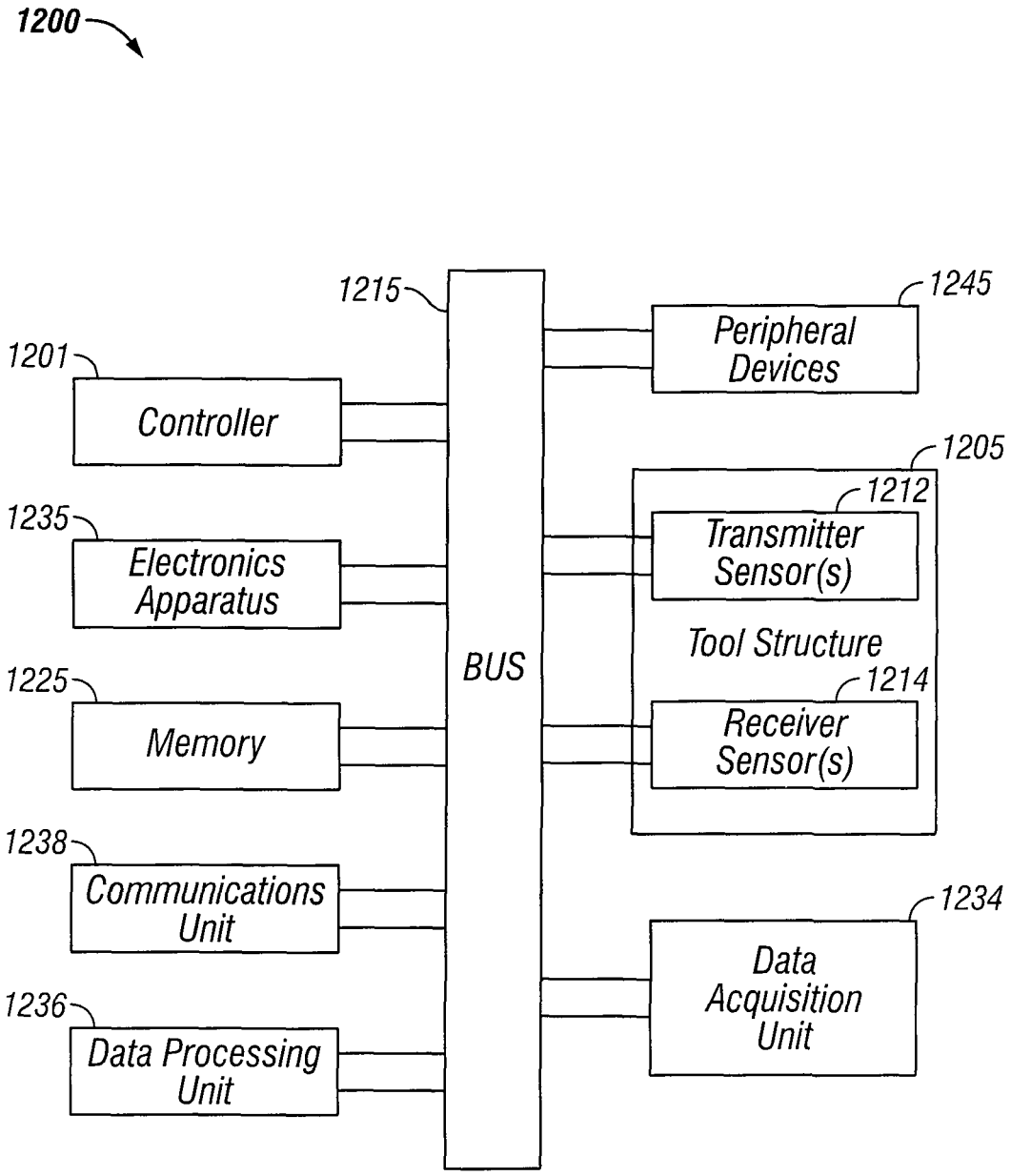
FIG. 12 depicts a block diagram of features of an example system having a processing unit operable with a deep-reading tool to geosteer a well to a target in a target zone, in accordance with various embodiments.

FIG. 12 depicts a block diagram of features of an example embodiment of a system 1200 having a tool structure 1205 configured with sensors arranged such that a transmitting sensor is set apart from a receiving sensor by a separation distance that is sufficiently large to provide real time processing of a signal received in response to a transmitted probe signal before reaching a boundary of a target zone in a drilling operation. System 1200 includes tool structure 1205 having an arrangement of transmitter sensors 1212 and receiver sensors 1214 that can be realized in a similar or identical manner to arrangements of sensors discussed herein. System 1200 can be configured to operate in accordance with the teachings herein.

System 1200 can include a controller 1201, a memory 1225, an electronic apparatus 1235, and a communications unit 1238. Controller 1201, memory 1225, and communications unit 1238 can be arranged to operate as a processing unit to control operation of tool structure 1205 having an arrangement of transmitter sensors 1212 and receiver sensors 1214 and to perform one or more inversion operations on the signals collected by tool structure 1205 to geosteer a well directed to a target in a target zone in a manner similar or identical to the procedures discussed herein. A data processing unit 1236, to engage in analysis of data to verify measurements and provide indications used to make course corrections to geosteer to the well, can be implemented as a single unit or distributed among the components of system 1200 including electronic apparatus 1235. Controller 1201 and memory 1225 can operate to control activation of transmitter sensors 1212 and selection of receiver sensors 1214 in tool structure 1205 and to manage processing schemes in accordance with measurement procedures and signal processing as described herein. A data acquisition unit 1234 can be structured to collect signals received at receiver sensors 1214 in response to probe signals generated by transmitter sensors 1212. Data acquisition unit 1234 can be implemented as a single unit or distributed among the components of system 1200 including electronic apparatus 1235. Data acquisition unit 1234, data processing unit 1236, and/or other components of system 1200 can be configured, for example, to operate similar to or identical to the components of tool 301 of FIG. 3 and/or similar to or identical to any of methods corresponding to FIGS. 4-6 and 10.

Communications unit 1238 can include downhole communications for appropriately located sensors. Such downhole communications can include a telemetry system. Communications unit 1238 may use combinations of wired communication technologies and wireless technologies at frequencies that do not interfere with on-going measurements.

System 1200 can also include a bus 1217, where bus 1217 provides electrical conductivity among the components of system 1200. Bus 1217 can include an address bus, a data bus, and a control bus, each independently configured or in an integrated format. Bus 1217 can be realized using a number of different communication mediums that allows for the distribution of components of system 1200. Use of bus 1217 can be regulated by controller 1201.

In various embodiments, peripheral devices 1245 can include displays, additional storage memory, and/or other control devices that may operate in conjunction with controller 1201 and/or memory 1225. In an embodiment, controller 1201 is realized as a processor or a group of processors that may operate independently depending on an assigned function. Peripheral devices 1245 can be arranged with a display, as a distributed component on the surface, that can be used with instructions stored in memory 1225 to implement a user interface to monitor the operation of tool 1205 and/or components distributed within system 1200. The user interface can be used to input parameter values for thresholds such that system 1200 can operate autonomously substantially without user intervention. The user interface can also provide for manual override and change of control of system 1200 to a user. Such a user interface can be operated in conjunction with communications unit 1238 and bus 1217.

Figure 13:
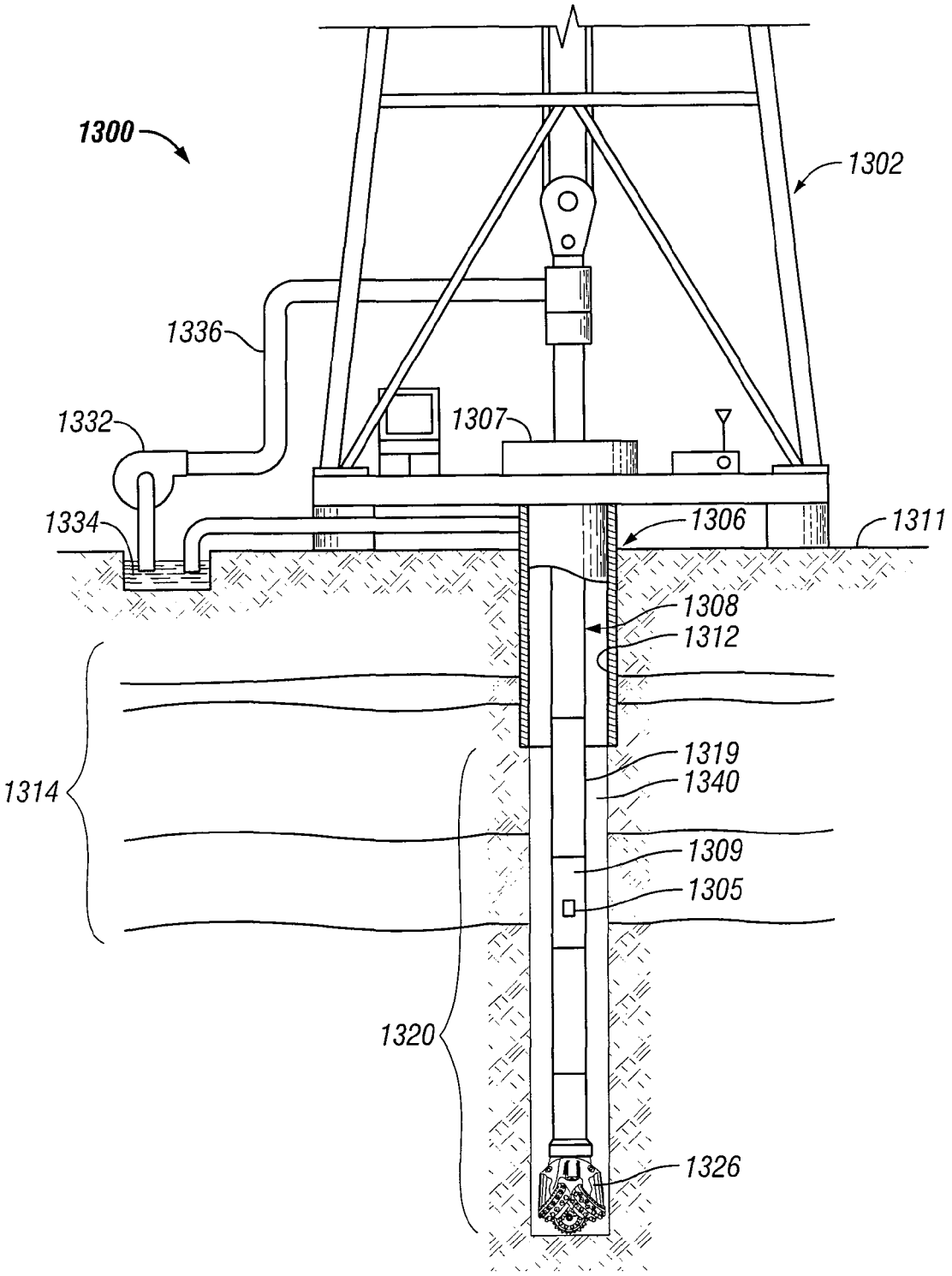
FIG. 13 depicts an example system at a drilling site, where the system includes a tool configured with deep-reading sensors to geosteer a well to a target in a target zone, in accordance with various embodiments.

FIG. 13 depicts an embodiment of a system 1300 at a drilling site, where system 1300 includes a tool 1305 configured with an arrangement of sensors such that receiver sensors are set apart from corresponding transmitter sensors by a separation distance that is sufficiently large to provide real time processing of a signal received in response to a transmitted probe signal before reaching a boundary of a target zone in a drilling operation. System 1300 includes tool 1305 having arrangements of transmitters and receivers that can be realized in a similar or identical manner to arrangements discussed herein to attain deep reading ahead of drill bit 1326. Tool 1305 can be structured and fabricated in accordance with various embodiments as taught herein with respect to a sensor tool having an arrangement of transmitters and receivers. For example, a transmitter sensor of tool 1305 can be disposed on drilled bit 1326 with one or more receivers on drill collars 1309 in a manner similar to or identical to the arrangement of transmitter sensor 212 on drill bit 226 and receiver sensors 214-1, 214-2, and 214-3 on drill collar 209 of FIG. 2.

System 1300 can include a drilling rig 1302 located at a surface 1311 of a well 1306 and a string of drill pipes, that is, drill string 1308, connected together so as to form a drilling string that is lowered through a rotary table 1307 into a wellbore or borehole 1312. The drilling rig 1302 can provide support for drill string 1308. The drill string 1308 can operate to penetrate rotary table 1307 for drilling a borehole 1312 through subsurface formations 1314. The drill string 1308 can include drill pipe 1319 and a bottom hole assembly 1320 located at the lower portion of the drill pipe 1319.

The bottom hole assembly 1320 can include drill collar 1309, tool 1305 attached to drill collar 1309, and a drill bit 1326. The drill bit 1326 can operate to create a borehole 1312 by penetrating the surface 1311 and subsurface formations 1314. Tool 1305 can be structured for an implementation in the borehole of a well as a MWD system such as a LWD system. The housing containing tool 1305 can include electronics to activate transmitters of tool 1305 and collect responses from receivers of tool 1305. Such electronics can include a processing unit to analyze signals sensed by tool 1305 and provide measurement results to the surface over a standard communication mechanism for operating a well. Alternatively, electronics can include a communications interface to provide signals sensed by tool 1305 to the surface over a standard communication mechanism for operating a well, where these sensed signals can be analyzed at a processing unit at the surface.

During drilling operations, the drill string 1308 can be rotated by the rotary table 1307. In addition to, or alternatively, the bottom hole assembly 1320 can also be rotated by a motor (e.g., a mud motor) that is located downhole. The drill collars 1309 can be used to add weight to the drill bit 1326. The drill collars 1309 also can stiffen the bottom hole assembly 1320 to allow the bottom hole assembly 1320 to transfer the added weight to the drill bit 1326, and in turn, assist the drill bit 1326 in penetrating the surface 1311 and subsurface formations 1314.

During drilling operations, a mud pump 1332 can pump drilling fluid (sometimes known by those of skill in the art as "drilling mud") from a mud pit 1334 through a hose 1336 into the drill pipe 1319 and down to the drill bit 1326. The drilling fluid can flow out from the drill bit 1326 and be returned to the surface 1311 through an annular area 1340 between the drill pipe 1319 and the sides of the borehole 1312. The drilling fluid may then be returned to the mud pit 1334, where such fluid is filtered. In some embodiments, the drilling fluid can be used to cool the drill bit 1326, as well as to provide lubrication for the drill bit 1326 during drilling operations. Additionally, the drilling fluid may be used to remove subsurface formation 1314 cuttings created by operating the drill bit 1326.

In various embodiments, a method utilizes deep-reading sensors to optimally land a well to a payzone with minimal or no overshoot. This method can minimize drilling cost and time. Further, such a method can keep the well in a target zone and can perform deep measurements of formation properties.

Although specific embodiments have been illustrated and described herein, it will be appreciated by those of ordinary skill in the art that any arrangement that is calculated to achieve the same purpose may be substituted for the specific embodiments shown. Various embodiments use permutations and/or combinations of embodiments described herein. It is to be understood that the above description is intended to be illustrative, and not restrictive, and that the phraseology or terminology employed herein is for the purpose of description. Combinations of the above embodiments and other embodiments will be apparent to those of skill in the art upon studying the above description.

What is claimed is:

1. An method comprising:

controlling activation of a transmitter sensor on a tool structure arranged relative to a drill bit in a well to probe a formation;

acquiring signals in a receiver sensor of the tool structure in response to activation of the transmitter sensor, the receiver sensor set apart from the transmitter sensor by a separation distance sufficiently large to provide real time processing of the signals prior to reaching a boundary of a target zone, wherein the separation distance is sufficiently large to sense ahead of the drill bit by a sensing distance ranging from above 10 feet up to 200 feet ahead of the drill bit;

processing the acquired signals in real time, including generating data corresponding to formation properties ahead of the drill bit including conducting inversion operations with respect to the acquired signals;

conducting a confidence verification process by comparison of results of at least two inversion operations from at least two acquired signals while drilling before using the results of the inversion operations to control geosteering the well; and geosteering the well when a difference between the at least two inversion operations is less than a threshold value and the generated data corresponds to desired formation properties such that the well approaches a target in the target zone with minimal or no overshoot of the target.

2. The method of claim 1, wherein the method includes:

repeating controlling activation of the transmitter sensor and acquiring signals corresponding to the activation at each of different log points during drilling the well;

conducting inversion operations on the acquired signals corresponding to the different log points, generating inverted data from the acquired signals correlated to the different log points;

performing a confidence process on the inverted data generated from the acquired signals correlated to the different log points;

adding, to a target list, inverted data that satisfied the confidence process, or parameters generated from the inverted data that satisfied the confidence process;

ranking the target list; and geosteering toward the target based on the ranked target list.

3. The method of claim 2, wherein ranking the target list includes sorting the target list with respect to time that the inverted data is generated.

4. The method of claim 3, wherein sorting the target list with respect to time includes applying weights such that higher weights are applied to most recently generated inverted data.

5. The method of claim 2, wherein ranking the target list includes computing forward responses for a number of target models, the forward responses being results of forward modeling with respect to the number of target models, and applying weights according to a difference between each forward response and a measured response corresponding to one or the acquired signals from which the inverted data or parameters is added to the target list such that the smaller the difference the higher is the weight assigned.

6. The method of claim 2, wherein ranking the target list includes calculating average values of the inverted data in the target list, and applying weights to the inverted data in the target list according to a difference between the inverted data in the target list and the average values of the inverted data in the target list such that the smaller the difference the higher is a value of weight assigned.

7. The method of claim 2, wherein ranking the target list, the target list having elements, includes:

sorting the target list with respect to time that the generated inverted data is generated, including a most recently generated inverted data, and applying a time weight such that a higher time weight is given to the most recently generated inverted data;

computing forward responses for a number of target models, the forward responses being results of forward modeling with respect to the number of target models, and applying response weights according to a difference between each forward response and a measured response corresponding to one or the acquired signals from which the inverted data or parameters is added to the target list such that the smaller the difference the higher is a value of response weight assigned;

calculating average values of the inverted data in the target list, and applying averaged value weights to the inverted data in the target list according to a difference between the inverted data in the target list and the average values of the inverted data in the target list such that the smaller the difference the higher is a value of averaged value weight assigned; and adding the time weight, the response weight, and the averaged value weight for each element in the target list to determine a model from which to geosteer.

8. The method of claim 2, wherein the method includes, after reaching the target, the target having a shape in the target zone:

repeating controlling activation of the transmitter sensor and acquiring a signal corresponding to the activation at each of different log points during drilling the well;

conducting inversion operations on the acquired signals corresponding to the different log points, generating inverted data from the acquired signals correlated to the different log points;

performing a confidence process on the inverted data generated from the acquired signals correlated to the different log points; and geosteering the well along the shape of the target.

9. The method of claim 1, wherein conducting the inversion operation includes generating a parameter set that minimizes error between measured voltage and a forward response of a forward model.

10. The method of claim 1, wherein geosteering the well includes directing drilling of the well to the target identified as a target plane in the target zone.

11. The method of claim 1, wherein geosteering the well includes geosteering along a course according to a dogleg criteria.

12. The method of claim 11, wherein the dogleg criteria includes a maximum angle of around 10° per 100 feet.

13. The method of claim 1, wherein the method includes iteratively controlling activation of the transmitter sensor, acquiring a signal corresponding to the activation, and processing the acquired signal to identify the target or the target zone.

14. The method of claim 1, wherein the method includes:

repeating controlling activation of the transmitter sensor, acquiring signals, in the receiver sensor or another receiver of the tool structure, corresponding to the activation, processing the acquired signals of the repeated acquisition to generate inverted data, and geosteering the well in an iteration process such that the iteration process provides for detection of the target or geosteering to the target;

generating, for a next signal to be acquired, an estimated signal value from processing a last signal processed;

acquiring the next signal and generating a measured signal value of the next signal; and if a difference between the estimated signal value and the measured signal value is within a threshold value, refraining from processing the acquired next signal to generate inverted data and accepting the inverted data generated from the last signal processed as accurate.

15. The method of claim 14, wherein generating, for the next signal to be acquired, the estimated signal value includes using a forward model.

16. The method of claim 15, wherein using a forward model includes using a forward model used in an inversion operation to generate the inverted data from the last signal.

17. The method of claim 1, wherein conducting the inversion operation includes generating one or more of a horizontal resistivity of a formation layer, a vertical resistivity of the formation layer, a distance of the drill bit to the target, a dip angle between an axis of the tool structure and a normal to the target, or an azimuth of the tool structure with respect to the target.

18. The method of claim 1, wherein conducting the inversion operation includes applying a Levenberg-Marquardt technique with respect to the acquired signal.

19. The method of claim 1, wherein geosteering the well includes geosteering the well based on comparing the generated data with the previously generated data.

20. An apparatus comprising:

a tool structure having a transmitter sensor and a receiver sensor set apart by a separation distance, the separation distance being sufficiently large to detect a boundary of a target zone from a distance from the boundary by a sensing distance ranging from above 10 feet up to 200 feet ahead of a drill bit in a drilling operation of a well to process data from collected received signals in the receiver sensor, in response to activation of the transmitter sensor to probe a formation, to approach a target in the target zone with minimal or no overshoot of the target, wherein the processing of data is in real time and includes generation of data corresponding to formation properties ahead of the drill bit including conduction of inversion operations with respect to the collected received signals and conduction of a confidence verification process by comparison of results of at least two inversion operations from at least two collected received signals while drilling before use of the results of the inversion operations to control geosteering the well, and including geosteering the well when a difference between the at least two inversion operations is less than a threshold value and the generated data corresponds to desired formation properties such that the well approaches a target in the target zone with minimal or no overshoot of the target.

21. The apparatus of claim 20, wherein the transmitter sensor and the receiver sensor includes one or more of a coil, a solenoid, a ring electrode, a button electrode, a toroidal sensor; an acoustic bender-bar, a magnetostrictive sensor, a piezoelectric sensor, or combinations thereof.

22. An apparatus comprising:

a tool structure having a transmitter sensor and a receiver sensor set apart by a separation distance;

a control unit operable to manage generation of transmission signals from the transmitter sensor to probe a formation and collection of received signals at the receiver sensor, each received signal based on one of the transmission signals; and a data processing unit operable to process data from the collected received signals to determine a target within a target zone for a drilling operation based on a comparison of the processed data with respect to a selected property identifying the target and to generate a signal to geosteer a drilling operation such that a well lands in the target zone based on the separation distance being sufficiently large to detect a boundary of the target zone from a distance from the boundary ranging from above 10 feet up to 200 feet ahead of a drill bit such that the data processing unit is operable in real time to process the data from the collected received signals to approach the target with minimal or no overshoot of the target, wherein the processing of data is in real time and includes generation of data corresponding to formation properties ahead of the drill bit including conduction of inversion operations with respect to the collected received signals and conduction of a confidence verification process by comparison of results of at least two inversion operations from at least two collected received signals while drilling before use of the results of the inversion operations to control geosteering the well, and including geosteering the well when a difference between the at least two inversion operations is less than a threshold value and the generated data corresponds to desired formation properties such that the well approaches a target in the target zone with minimal or no overshoot of the target.

23. The apparatus of claim 22, wherein the transmitter sensor is disposed on a drill bit.

24. A non-transitory machine-readable storage device having instructions stored thereon, which, when performed by a machine, cause the machine to perform operations, the operations comprising:

controlling activation of a transmitter sensor on a tool structure arranged relative to a drill bit in a well to probe a formation;

acquiring signals in a receiver sensor of the tool structure in response to activation of the transmitter sensor, the receiver sensor set apart from the transmitter sensor by a separation distance sufficiently large to provide real time processing of the acquired signals prior to reaching a boundary of a target zone, wherein the separation distance is sufficiently large to sense ahead of the drill bit by a sensing distance ranging from above 10 feet up to 200 feet ahead of the drill bit;

processing the acquired signals in real time, including generating data corresponding to formation properties ahead of the drill bit including conducting inversion operations with respect to the acquired signals;

conducting a confidence verification process by comparison of results of at least two inversion operations from at least two acquired signals while drilling before using the results of the inversion operations to control geosteering the well; and geosteering the well when a difference between the at least two inversion operations is less than a threshold value and the generated data corresponds to desired formation properties such that the well approaches a target in the target zone with minimal or no overshoot of the target.

25. The no-transitory machine-readable storage device of claim 24, wherein the instructions include instructions to:

repeat controlling activation of the transmitter sensor and acquiring signals corresponding to the activation at each of different log points during drilling the well;

conduct inversion operations on the acquired signals corresponding to the different log points, generating inverted data from the acquired signals correlated to the different log points;

perform a confidence process on the inverted data generated from the acquired signals correlated to the different log points;

add, to a target list, inverted data that satisfied the confidence process, or parameters generated from the inverted data that satisfied the confidence process;

rank the target list; and geosteer toward the target based on the ranked target list.

* * * * *